US011624252B1

(12) United States Patent
Al-Mousa et al.

(10) Patent No.: US 11,624,252 B1
(45) Date of Patent: Apr. 11, 2023

(54) ADJUSTABLE MILL

(71) Applicant: SAUDI ARABIAN OIL COMPANY, Dhahran (SA)

(72) Inventors: Ahmed A. Al-Mousa, Doha (SA); Bader M. Al-Ahmad, Dhahran (SA); Omar M. Alhamid, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/479,568

(22) Filed: Sep. 20, 2021

(51) Int. Cl.
*E21B 31/00* (2006.01)
*E21B 31/113* (2006.01)
*E21B 31/06* (2006.01)

(52) U.S. Cl.
CPC ..... *E21B 31/002* (2013.01); *E21B 31/06* (2013.01); *E21B 31/113* (2013.01)

(58) Field of Classification Search
CPC ..... E21B 29/00; E21B 31/00
See application file for complete search history.

(56) References Cited

U.S. PATENT DOCUMENTS 2,710,654 A * 6/1955 Clayton ..... E21B 31/00 166/55.6
4,768,588 A * 9/1988 Kupsa ..... E21B 29/00 175/320
5,727,629 A 3/1998 Blizzard, Jr. et al.
6,170,576 B1 * 1/2001 Brunnert ..... E21B 29/00 166/55.6
9,187,971 B2 11/2015 Hutchinson
11,448,028 B2 * 9/2022 Al-Mousa ..... E21B 29/005
2011/0220357 A1 * 9/2011 Segura ..... E21B 29/005 166/55.3
2013/0153227 A1 * 6/2013 Laird ..... E21B 31/00 166/305.1
2020/0032604 A1 * 1/2020 Al-Ramadhan ..... E21B 27/00
2020/0157903 A1 * 5/2020 Al-Mousa ..... E21B 29/002
2021/0404262 A1 * 12/2021 Spinnangr ..... E21B 29/002
2022/0056776 A1 * 2/2022 Alzayer ..... E21B 47/09
2022/0341273 A1 * 10/2022 Al-Mousa ..... E21B 31/005

FOREIGN PATENT DOCUMENTS

CN 201891401 U 7/2011

* cited by examiner

*Primary Examiner* — Shane Bomar
(74) *Attorney, Agent, or Firm* — Osha Bergman Watanabe & Burton LLP

(57) ABSTRACT

A system includes a deployment device and an adjustable mill. The deployment device has a box end with internal threads. The adjustable mill has a tubular body, a cylinder, and a lock ring. The tubular body has a lateral end and a pin end. The pin end has external threads, the lateral end is partially enveloped by cutters, and the lateral end comprises an inner wall defining an orifice. The cylinder is movably disposed within the orifice. The cylinder is partially enveloped by the cutters. The lock ring is disposed circumferentially around the cylinder. The lock ring interacts with a lock ring seat machined into the inner wall of the lateral end to place the adjustable mill in a mode. The internal threads of the adjustable mill and the external threads of the deployment device interact to form a connection between the adjustable mill and the deployment device.

20 Claims, 5 Drawing Sheets

ADJUSTABLE MILL

BACKGROUND

In the oil and gas industry, hydrocarbons are located in porous formations far beneath the Earth's surface. Wells are drilled into these formations to access and produce said hydrocarbons. Oftentimes, during drilling the well or throughout the life of the well, equipment or junk gets lost in the well. The equipment or junk that gets lost in a well is called a fish. A fishing job may ensue to clear the well of the fish.

Fishing jobs may include running fishing tools to latch onto the fish and pull the fish out of the hole. Fishing jobs may also include drilling out the fish. Drilling out the fish includes running a mill into the well and drilling, or "milling," the fish. A mill is a specially designed drill bit that is meant to drill through metals such as casing and fish, whereas a conventional drill bit is used to drill through formations and plastics. Mills are often designed in different shapes depending on the shape of the fish that is lost in the hole.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

The present invention presents, in one or more embodiments, methods and system for using an adjustable mill. The system includes a deployment device and an adjustable mill. The deployment device has a box end with internal threads disposed around an internal circumferential surface. The adjustable mill has a tubular body, a cylinder, and a lock ring. The tubular body has a lateral end and a pin end. The pin end has external threads disposed around an external circumferential surface of the pin end, the lateral end is partially enveloped by a plurality of cutters, and the lateral end comprises an inner wall defining an orifice. The cylinder is movably disposed within the orifice of the lateral end of the tubular body. The cylinder is partially enveloped by the plurality of cutters. The lock ring is disposed circumferentially around the cylinder. The lock ring is configured to interact with a lock ring seat machined into the inner wall of the lateral end to place the adjustable mill in a mode. The internal threads of the adjustable mill and the external threads of the deployment device interact to form a connection between the adjustable mill and the deployment device.

The method is for a well having a fish and the method initially includes providing an adjustable mill. The adjustable mill has a tubular body, a cylinder, and a lock ring. The tubular body has a lateral end and a pin end. The pin end has external threads disposed around an external circumferential surface of the pin end, the lateral end is partially enveloped by a plurality of cutters, and the lateral end comprises an inner wall defining an orifice. The cylinder is movably disposed within the orifice of the lateral end of the tubular body. The cylinder is partially enveloped by the plurality of cutters. The lock ring is disposed circumferentially around the cylinder. The lock ring is configured to interact with a lock ring seat machined into the inner wall of the lateral end. The method further includes connecting the adjustable mill to a deployment device, having a box end with internal threads, by threading together the internal threads and the external threads, lowering the adjustable mill into the well using the deployment device, lowering the adjustable mill onto the fish to adjust a mode of the adjustable mill, and drilling the fish out of the well using the adjustable mill.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
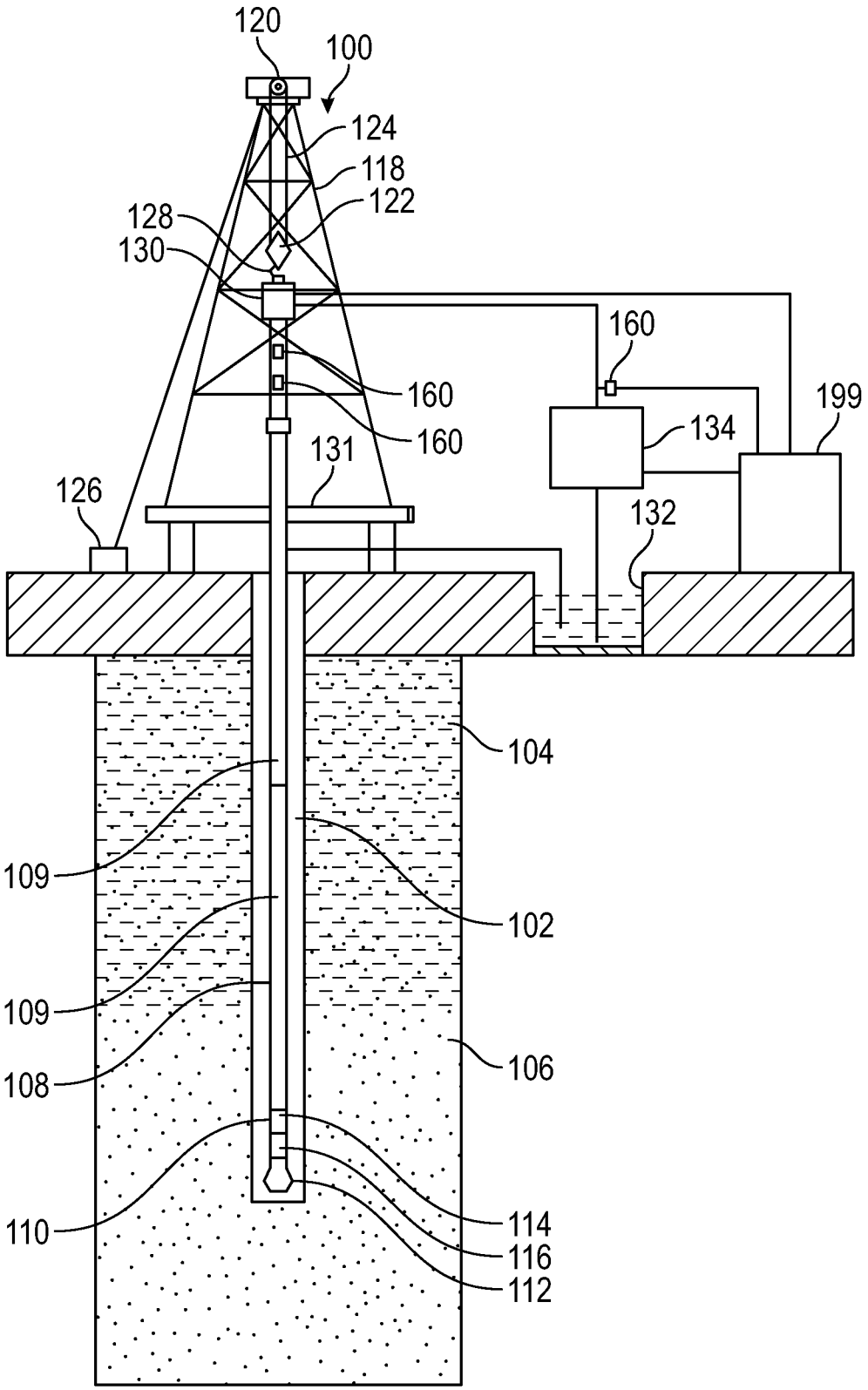
FIG. 1 shows an exemplary well site in accordance with one or more embodiments.

FIG. 1 illustrates an exemplary well site (100). In general, well sites may be configured in a myriad of ways. Therefore, well site (100) is not intended to be limiting with respect to the particular configuration of the drilling equipment. The well site (100) is depicted as being on land. In other examples, the well site (100) may be offshore, and drilling may be carried out with or without use of a marine riser. A drilling operation at well site (100) may include drilling a wellbore (102) into a subsurface including various formations (104, 106). For the purpose of drilling a new section of wellbore (102), a drill string (108) is suspended within the wellbore (102).

The drill string (108) may include one or more drill pipes (109) connected to form conduit and a bottom hole assembly (BHA) (110) disposed at the distal end of the conduit. The BHA (110) may include a drill bit (112) to cut into the subsurface rock. The BHA (110) may include measurement tools, such as a measurement-while-drilling (MWD) tool (114) and logging-while-drilling (LWD) tool 116. Measurement tools (114, 116) may include sensors and hardware to measure downhole drilling parameters, and these measurements may be transmitted to the surface using any suitable telemetry system known in the art. The BHA (110) and the drill string (108) may include other drilling tools known in the art but not specifically shown.

The drill string (108) may be suspended in wellbore (102) by a derrick (118). A crown block (120) may be mounted at the top of the derrick (118), and a traveling block (122) may hang down from the crown block (120) by means of a cable or drilling line (124). One end of the cable (124) may be connected to a drawworks (126), which is a reeling device that may be used to adjust the length of the cable (124) so that the traveling block (122) may move up or down the derrick (118). The traveling block (122) may include a hook (128) on which a top drive (130) is supported.

The top drive (130) is coupled to the top of the drill string (108) and is operable to rotate the drill string (108). Alternatively, the drill string (108) may be rotated by means of a rotary table (not shown) on the drilling floor (131). Drilling fluid (commonly called mud) may be stored in a mud pit (132), and at least one pump (134) may pump the mud from the mud pit (132) into the drill string (108). The mud may flow into the drill string (108) through appropriate flow paths in the top drive (130) (or a rotary swivel if a rotary table is used instead of a top drive to rotate the drill string (108)).

In one implementation, a system (199) may be disposed at or communicate with the well site (100). System (199) may control at least a portion of a drilling operation at the well site (100) by providing controls to various components of the drilling operation. In one or more embodiments, system (199) may receive data from one or more sensors (160) arranged to measure controllable parameters of the drilling operation. As a non-limiting example, sensors (160) may be arranged to measure WOB (weight on bit), RPM (drill string rotational speed), GPM (flow rate of the mud pumps), and ROP (rate of penetration of the drilling operation).

Sensors (160) may be positioned to measure parameter(s) related to the rotation of the drill string (108), parameter(s) related to travel of the traveling block (122), which may be used to determine ROP of the drilling operation, and parameter(s) related to flow rate of the pump (134). For illustration purposes, sensors (160) are shown on drill string (108) and proximate mud pump (134). The illustrated locations of sensors (160) are not intended to be limiting, and sensors (160) could be disposed wherever drilling parameters need to be measured. Moreover, there may be many more sensors (160) than shown in FIG. 1 to measure various other parameters of the drilling operation. Each sensor (160) may be configured to measure a desired physical stimulus.

During a drilling operation at the well site (100), the drill string (108) is rotated relative to the wellbore (102), and weight is applied to the drill bit (112) to enable the drill bit (112) to break rock as the drill string (108) is rotated. In some cases, the drill bit (112) may be rotated independently with a drilling motor. In further embodiments, the drill bit (112) may be rotated using a combination of the drilling motor and the top drive (130) (or a rotary swivel if a rotary table is used instead of a top drive to rotate the drill string (108)). While cutting rock with the drill bit (112), mud is pumped into the drill string (108).

The mud flows down the drill string (108) and exits into the bottom of the wellbore (102) through nozzles in the drill bit (112). The mud in the wellbore (102) then flows back up to the surface in an annular space between the drill string (108) and the wellbore (102) with entrained cuttings. The mud with the cuttings is returned to the pit (132) to be circulated back again into the drill string (108). Typically, the cuttings are removed from the mud, and the mud is reconditioned as necessary, before pumping the mud again into the drill string (108). In one or more embodiments, the drilling operation may be controlled by the system (199).

While drilling the wellbore (102), as described above, various pieces of equipment such as the drill bit (112) or a portion of the drill string (108) may be disconnected from the surface portion of the well site (100) (surface portion being on or above the surface of the Earth) and be lost to the downhole portion of the well site (100) (downhole portion being anywhere beneath the surface of the Earth). The downhole portion of the well site (100) is called the well herein. Equipment or junk that is lost in the well is called a fish. A fish may come from a drilling operation as described above, or a fish may come from any other operation without departing from the scope of this disclosure herein.

The fish may be fished or drilled out to clear the well for production and/or continuing operations. When a fish is drilled out of the well, a mill is used in place of a conventional drill bit (112). A mill is designed to drill through tougher materials, such as steel, when compared to a conventional drill bit (112). Further, mills are available in a plurality of different mill shapes depending on the shape of the fish. However, mills are confined to being one shape and oftentimes the wrong mill shape is used to drill out the fish, because it is difficult to know what the fish looks like downhole. Therefore, a mill that is able to change shapes while downhole is beneficial. As such, embodiments disclosed herein present systems and methods for an adjustable mill that is able to change shapes downhole depending on the shape of the fish.

Figure 2A:
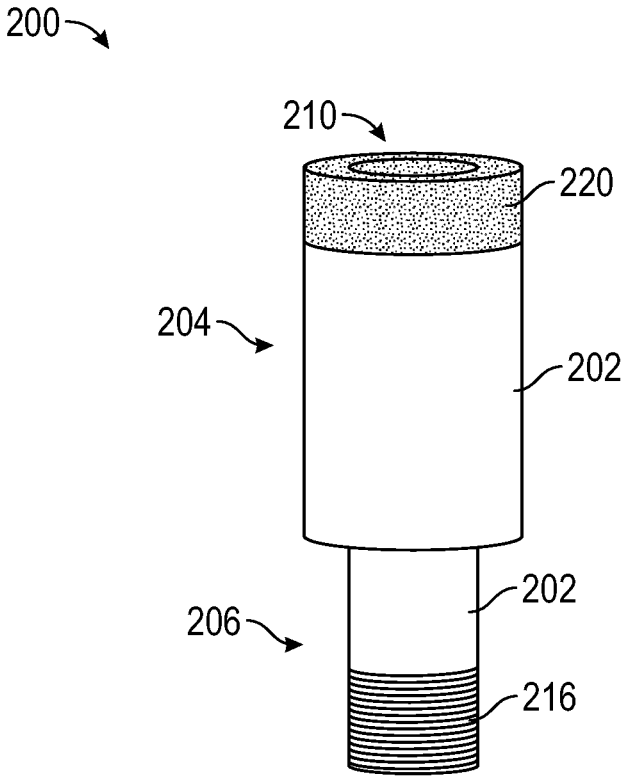
FIGS. 2*a* and 2*b* show an adjustable mill in accordance with one or more embodiments.
Figure 2B:
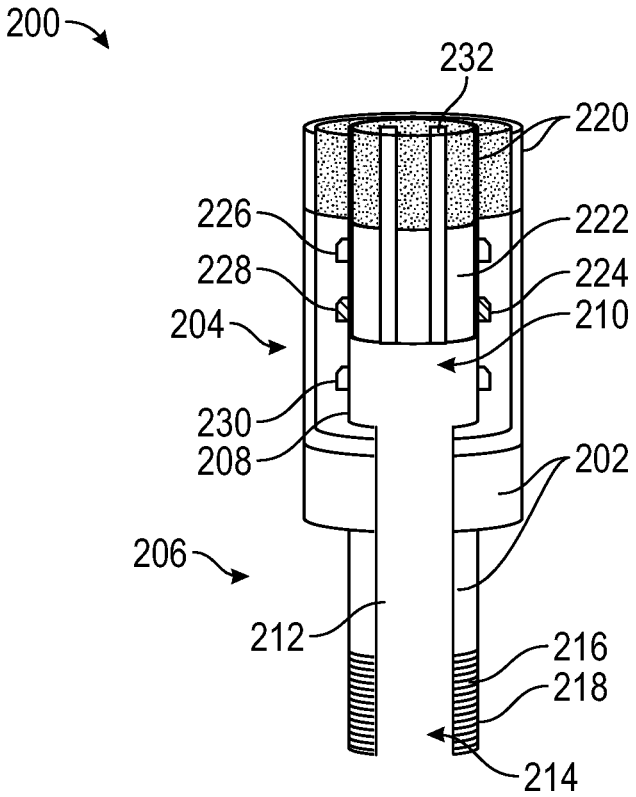

FIGS. 2*a* and 2*b* show an adjustable mill (200) in accordance with one or more embodiments. More specifically, FIG. 2*a* shows an external view of the adjustable mill (200) and FIG. 2*b* shows a cross sectional view of the adjustable mill (200). The adjustable mill (200) is made of a tubular body (202). The tubular body (202) may be made of a durable material, such as steel-4140 alloy. The tubular body (202) is divided into two sections: a lateral end (204) and a pin end (206). The pin end (206) and the lateral end (204) may have different outer diameters, as shown in FIGS. 2*a* and 2*b*, or the pin end (206) and lateral end (204) may be the same size making the two sections indistinguishable from one another.

Because the lateral end (204) and the pin end (206) are in a tubular shape, the lateral end (204) has an inner wall (208) defining an orifice (210) and the pin end (206) has an inner surface (212) defining a passage (214). As shown in FIG. 2*b*, the orifice (210) and the passage (214) are different sizes, however the orifice (210) and the passage (214) may be the same size without departing from the scope of the disclosure herein. The pin end (206) has external threads (216) disposed around an external circumferential surface (218) of the pin end (206). The external threads (216) may be any type of thread known in the art such as box threads, tapered threads, etc.

The lateral end (204) of the tubular body (202) is partially enveloped by a plurality of cutters (220). The portion of the lateral end (204) that is enveloped by cutters (220) may be the portion that faces an external environment of the adjustable mill (200). The cutters (220) may be any type of cutters (220) known in the art, such as tungsten carbide cutters (220). A cylinder (222) is movably disposed within the orifice (210) of the lateral end (204) of the tubular body (202). The cylinder (222) is also partially enveloped by a plurality of cutters (220). The cutters (220) disposed on the cylinder (222) and the cutters (220) disposed on the lateral end (204) are the same. The portion of the cylinder (222) that is enveloped by the cutters (220) is also the portion that faces or could face the external environment of the adjustable mill (200).

The cylinder (222) is moveably disposed within the orifice (210) of the lateral end (204) of the tubular body (202). This means that the cylinder (222) is able to move up and down, in relation to the inner wall (208) of the orifice (210), such that the cylinder (222) may be completely within the orifice (210), or a portion of the cylinder (222) extends out of the orifice (210). FIGS. 2*a* and 2*b* show the cylinder (222) flush with the tubular body (202). The cylinder (222) further includes a lock ring (224) disposed circumferentially around the cylinder (222). The lock ring (224) is designed to interact with a lock ring seat (226, 228, 230) machined into the inner wall (208) of the lateral end (204) to place the adjustable mill (200) in a mode.

FIG. 2*b* shows the adjustable mill (200) having a first lock ring seat (226), a second lock ring seat (228), and a third lock ring seat (230). The lock ring (224) is depicted as inserted into the second lock ring seat (228). As such, the corresponding mode is shown as having the cylinder (222) be flush with the tubular body (202). Three lock ring seats (226, 228, 230) are shown in FIG. 2*b*; however, any number of lock ring seats (226, 228, 230) may be machined into the inner wall (208), allowing the cylinder (222) to be placed in a plurality of different positions, without departing from the scope of the disclosure herein. In other embodiments, the cylinder (222) has at least one nozzle (232) traversing longitudinally through the cylinder (222) creating a hydraulic connection between the orifice (210) and the external environment of the adjustable mill (200). The nozzle (232) may be any type of drill bit (112) or mill bit nozzle known in the art. FIG. 2*b* shows the adjustable mill (200) having two nozzles (232).

Figure 3C:
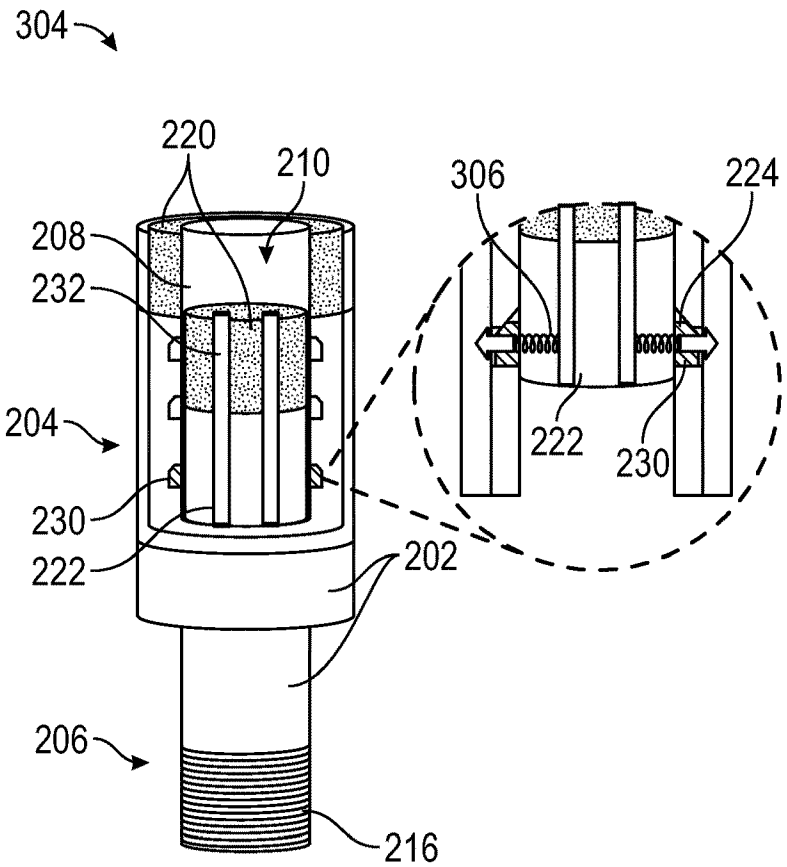
FIGS. 3*a*-3*c* show the adjustable mill in three different modes in accordance with one or more embodiments.
Figure 3B:
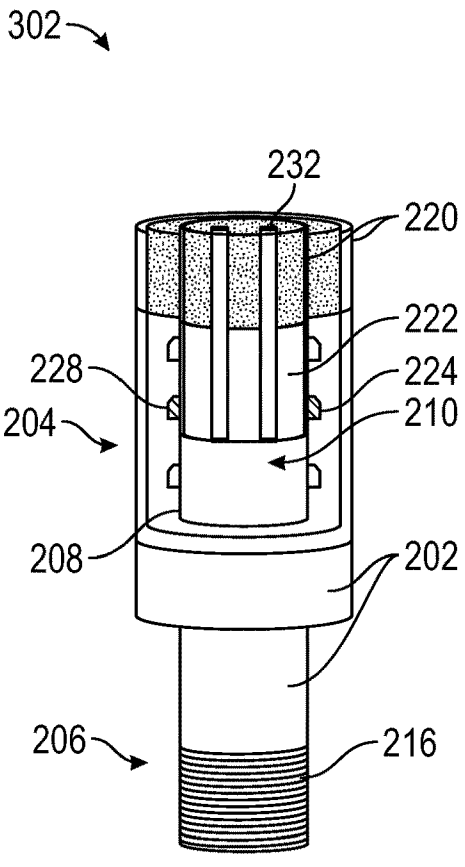
Figure 3A:
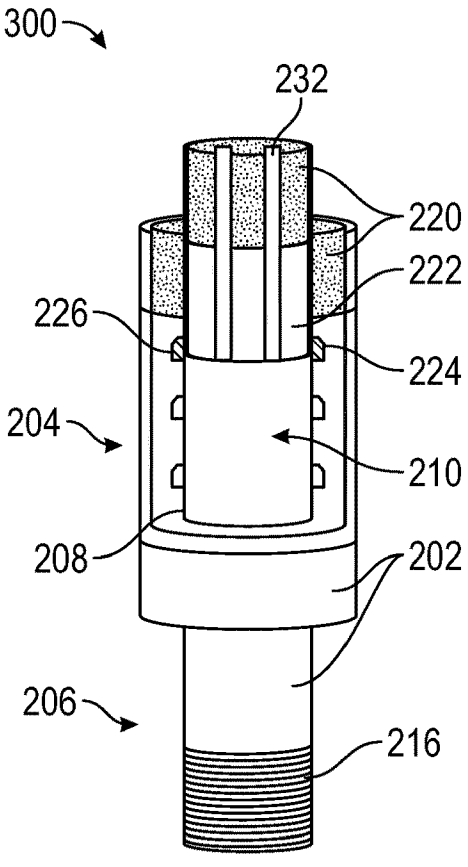

FIGS. 3*a*-3*c* show the adjustable mill (200), as described in FIG. 1, in three different modes in accordance with one or more embodiments. Components shown in FIGS. 3*a*-2*c* that are the same as or similar to components shown in FIGS. 1-2*b* have not been redescribed for purposes of readability and have the same functions as described above. More specifically, FIG. 3*a* shows the adjustable mill (200) in a first mode (300), FIG. 3*b* shows the adjustable mill (200) in a second mode (302), and FIG. 3*c* shows the adjustable mill (200) in a third mode (304). Further, FIG. 3*c* shows an expanded image of how the lock ring (224) interacts with the lock ring seats (226, 228, 230).

FIG. 3*a* shows the lock ring (224) entered into the first lock ring seat (226). This places the adjustable mill (200) in the first mode (300). The first mode (300) may be the default mode of the adjustable mill (200). This means that the adjustable mill (200) may be run into a well in the first mode (300). The first mode (300) may be called a taper mill. The first mode (300) is effective when the fish has a small cross section opening at the center of the fish. FIG. 3*b* shows the lock ring (224) entered into the second lock ring seat (228). This places the adjustable mill (200) in the second mode (302). The second mode (302) may be called a flat bottom mill. The second mode (302) is effective when the fish has a flat surface.

FIG. 3*c* shows the lock ring (224) entered into the third lock ring seat (230). This places the adjustable mill (200) in the third mode (304). The third mode (304) may be called a burn shoe. The third mode (304) is effective when the fish has a piece of pipe sticking up from the center. The lock ring (224) is held in place using a spring (306) as shown in FIG. 3*c*. When a certain pressure is seen on the cylinder (222), the lock ring (224) may be pushed from the first lock ring seat (226) and into whichever lock ring seat (226, 228, 230) that would make the mode of the adjustable mill (200) fit the shape of the fish.

Figure 4B:
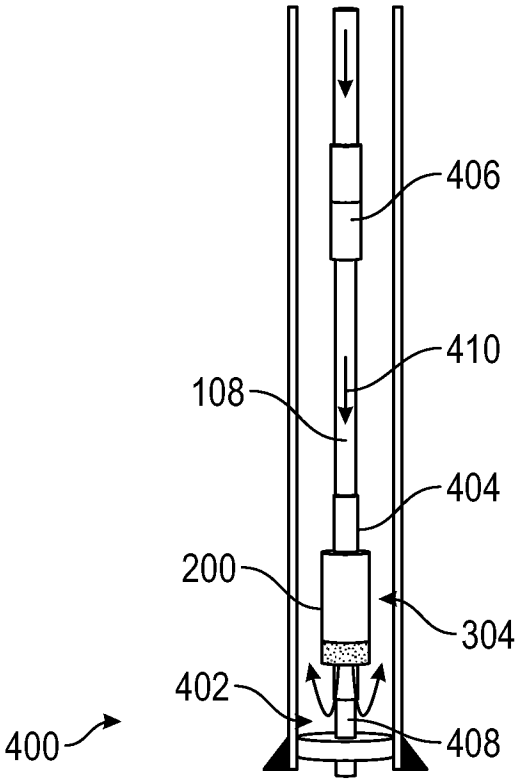
FIGS. 4*a* and 4*b* show the adjustable mill deployed in a well in accordance with one or more embodiments.
Figure 4A:
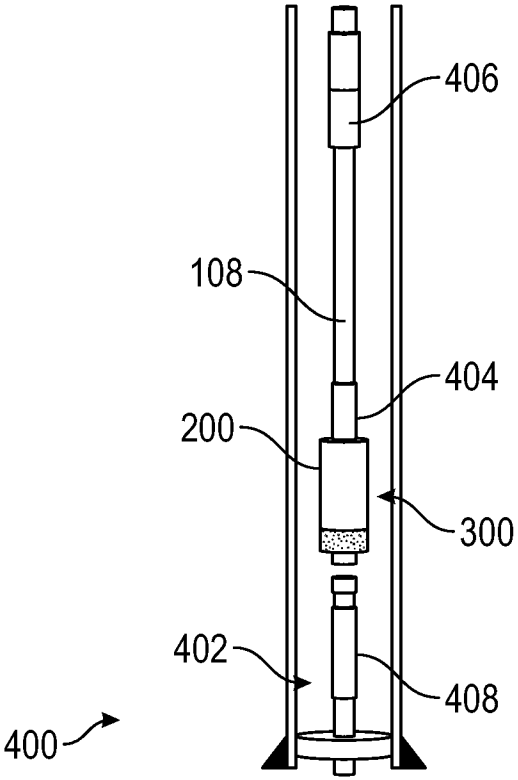

FIGS. 4*a* and 4*b* show the adjustable mill (200) deployed in a well (400) having a fish (402) in accordance with one or more embodiments. Components of FIGS. 4*a* and 4*b* that are the same as or similar to components shown in FIGS. 1-3*c* have not been redescribed for purposes of readability and have the same purpose as described above. More specifically, FIG. 4*a* shows the adjustable mill (200) being lowered into the well (400) on a deployment device. The deployment device has a box end (404) with internal threads (not pictured) disposed around an internal circumferential surface (not pictured) of the deployment device.

The deployment device is shown in FIGS. 4*a* and 4*b* as a drill string (108), however, the deployment device may be any deployment device known in the art, such as coiled tubing. The drill string (108) is shown in FIGS. 4*a* and 4*b* as being connected to the adjustable mill (200). The external threads (216) of the adjustable mill (200) and the internal threads of the drill string (108) interact to form a connection between the adjustable mill (200) and the drill string (108). The adjustable mill (200) is shown being lowered into the well (400) in the first mode (300), as depicted more specifically in FIG. 3*a*. The drill string (108) has a milling bottom hole assembly (BHA) (406). The milling BHA (406) may be a BHA (110) similar to the BHA (110) described in FIG. 1 but with components that aid in milling operations. As such, the milling BHA (406) may have a drill collar, a junk basket, a magnet, and/or ajar.

FIG. 4*b* shows the drill string (108) and adjustable mill (200) completely lowered on top of the fish (402). The fish (402) is shown as having a pipe (408) pointing upwards (towards the adjustable mill (200)) from the body of the fish (402). As such, the adjustable mill (200) is shown in FIG. 4*b* being in the third mode (304). As the adjustable mill (200), being in the first mode (300), was lowered onto the fish (402), the extending pipe (408) of the fish (402) exerted a pressure onto the cylinder (222) that pushed the lock ring (224) out of the first lock ring seat (226) and into the third lock ring seat (230) to place the adjustable mill (200) into the third mode (304).

FIG. 4*b* also shows a fluid (410) being pumped from the surface of the Earth, through the drill string (108) and out the bottom of the adjustable mill (200) (the bottom being the portion closer to the fish (402)). Because of the connection formed between the drill string (108) and the adjustable mill (200), the fluid (410) is free to move from the drill string (108) into the adjustable mill (200). More specifically, the fluid (410) moves from the drill string (108) into the passage (214) and orifice (210) of the adjustable mill (200). Because of the nozzles (232) in the cylinder (222) of the adjustable mill (200), a hydraulic connection is present between the orifice (210) and an external environment, such as the well (400). As such, the fluid (410) is free to move from the drill string (108), into the passage (214) and orifice (210), through the nozzles (232), and into the well (400). The fluid (410) helps cool down the adjustable mill (200) and helps carries cuttings (i.e., broken up pieces of the fish (402)) to the surface of the Earth.

Figure 5:
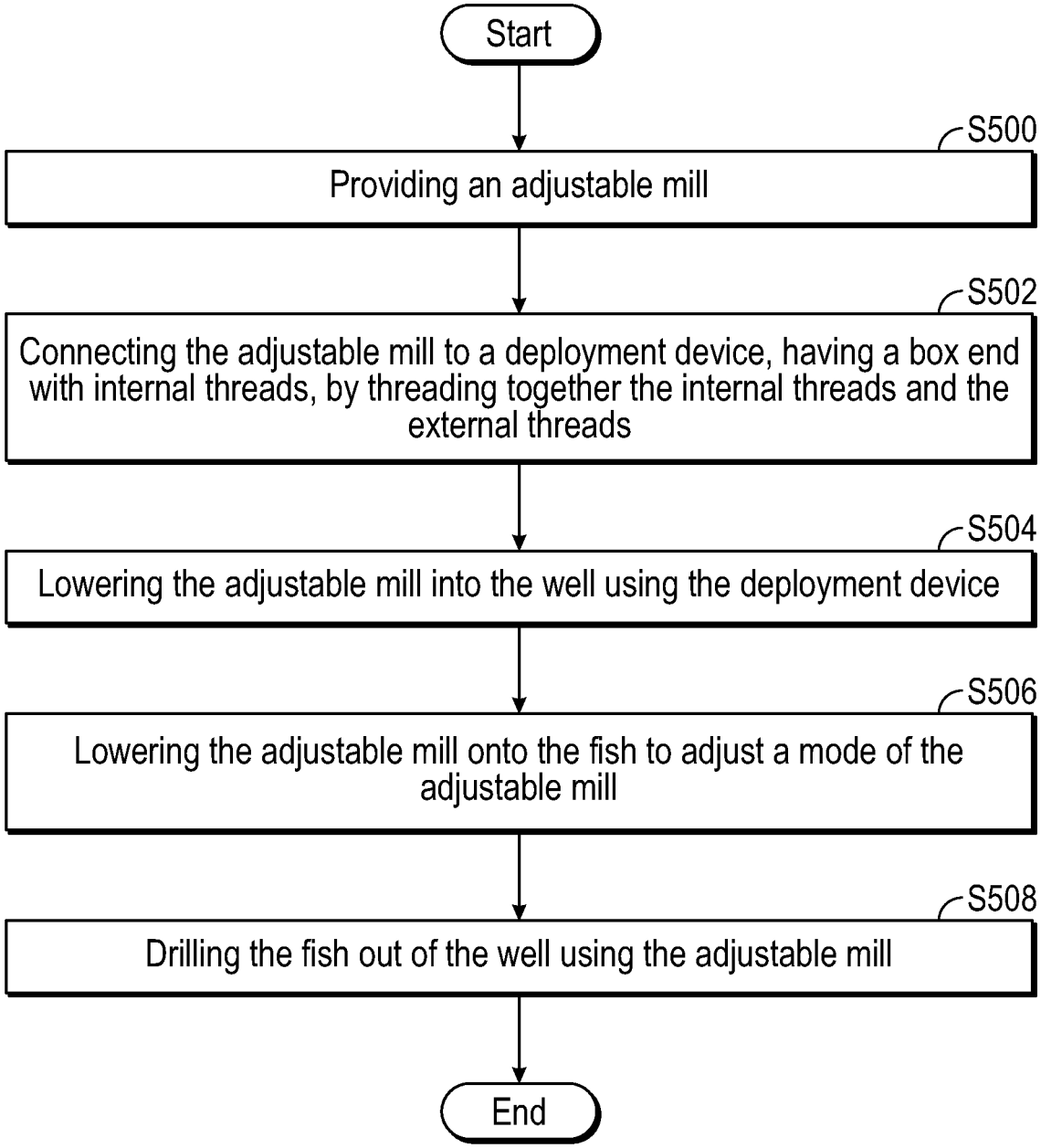
FIG. 5 shows a flowchart in accordance with one or more embodiments.

FIG. 5 depicts a flowchart in accordance with one or more embodiments. More specifically, FIG. 5 illustrates a method for drilling out a fish (402) located in a well (400). Further, one or more blocks in FIG. 5 may be performed by one or more components as described in FIGS. 1-4*b* (e.g., adjustable mill (200). While the various blocks in FIG. 5 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, an adjustable mill (200) is provided (S500). The adjustable mill (200) is made of a lateral end (204) and a pin end (206). The pin end (206) has external threads. The lateral end (204) has an orifice (210) defined by an inner wall (208). A cylinder (222) is moveably disposed within the orifice (210). The inner wall (208) of the lateral end (204) has at least one lock ring seat (226, 228, 230) machined into the inner wall (208). The lock ring seat (226, 228, 230) corresponds to a lock ring (224) disposed around the cylinder (222). The lateral end (204) may have three lock ring seats (226, 228, 230) machined into the inner wall (208): a first lock ring seat (226), a second lock ring seat (228), and a third lock ring seat (230).

The adjustable mill (200) is connected to a deployment device, having a box end (404) with internal threads, by threading together the internal threads and the external threads (216) (S502). The deployment device may be a drill string (108) as described in FIGS. 4*a* and 4*b*. The adjustable mill (200) is lowered into the well (400) using the deployment device (S504). The adjustable mill (200) is lowered onto the fish (402) to adjust a mode of the adjustable mill (200) (S506). The adjustable mill (200) may be placed in a first mode (300) by pushing the lock ring (224) into the first lock ring seat (226). The adjustable mill (200) may be placed in a second mode (302) by pushing the lock ring (224) into the second lock ring seat (228). The adjustable mill (200) may be placed in a third mode (304) by pushing the lock ring (224) into the third lock ring seat (230).

In one or more embodiment, the adjustable mill (200) is lowered into the well (400) on a drill string (108). The adjustable mill (200) is run into the well (400) in the first mode (300). When the adjustable mill (200) is located directly above the fish (402) in the well (400), then a weight, such as 30k-lbs of slack off weight, may be applied against the fish (402). The adjustable mill (200) will either stay in the first mode (300) or the adjustable mill will change into the second mode (302) or the third mode (304) depending on the shape of the fish (402) and how that shape of the fish (402) distributes the resistance of the weight onto the adjustable mill (200).

The fish (402) is drilled out of the well (400) using the adjustable mill (200) (S508) and whichever mode the adjustable mill (200) has transformed into. The cutters (220) located on the cylinder (222) and the lateral end (204) aid in breaking down the fish (402). While the fish (402) is being drilled out of the well (400), a fluid (410) may be pumped from the drill string (108) to the adjustable mill (200), through at least one nozzle (232), and into the external environment. The external environment may be the well (400). The fluid (410) may carry pieces of the drilled-out fish (402) to the surface of the Earth. In other embodiments, as the pieces of the fish (402) are being carried to the surface of the Earth, the junk basket, located in the milling BHA (406), may catch the larger pieces of the drilled-out fish (402).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A system comprising:

a deployment device having a box end with internal threads disposed around an internal circumferential surface; and an adjustable mill comprising:

a tubular body having a lateral end and a pin end, wherein the pin end has external threads disposed around an external circumferential surface of the pin end and the lateral end is partially enveloped by a plurality of cutters and the lateral end comprises an inner wall defining an orifice;

a cylinder movably disposed within the orifice of the lateral end of the tubular body, wherein the cylinder is partially enveloped by the plurality of cutters; and a lock ring disposed circumferentially around the cylinder, wherein the lock ring is configured to interact with a lock ring seat machined into the inner wall of the lateral end to place the adjustable mill in a mode;

wherein the internal threads of the adjustable mill and the external threads of the deployment device interact to form a connection between the adjustable mill and the deployment device.

2. The system of claim 1, wherein a fluid is free to move from the deployment device to the adjustable mill when the connection is formed between the adjustable mill and the deployment device.

3. The system of claim 2, wherein the cylinder further comprises at least one nozzle traversing longitudinally through the cylinder creating a hydraulic connection between the orifice and an external environment.

4. The system of claim 1, wherein the lock ring seat further comprises a first lock ring seat, a second lock ring seat, and a third lock ring seat.

5. The system of claim 4, wherein the adjustable mill has a first mode that is created when the lock ring enters the first lock ring seat.

6. The system of claim 5, wherein the adjustable mill has a second mode that is created when the lock ring enters the second lock ring seat.

7. The system of claim 6, wherein the adjustable mill has a third mode that is created when the lock ring enters the third lock ring seat.

8. The system of claim 7, further comprising:

a fish, wherein a shape of the fish changes the mode of the adjustable mill.

9. The system of claim 1, wherein the deployment device further comprises a drill string having a milling bottom hole assembly.

10. The system of claim 9, wherein the milling bottom hole assembly further comprises a drill collar, a junk basket, a magnet, and a jar.

11. A method for a well having a fish, the method comprising:

providing an adjustable mill comprising:

a tubular body having a lateral end and a pin end, wherein the pin end has external threads disposed around an external circumferential surface of the pin end and the lateral end is partially enveloped by a plurality of cutters and the lateral end comprises an inner wall defining an orifice;

a cylinder movably disposed within the orifice of the lateral end of the tubular body, wherein the cylinder is partially enveloped by the plurality of cutters;

a lock ring disposed circumferentially around the cylinder, wherein the lock ring is configured to interact with a lock ring seat machined into the inner wall of the lateral end;

connecting the adjustable mill to a deployment device, having a box end with internal threads, by threading together the internal threads and the external threads;

lowering the adjustable mill into the well using the deployment device;

lowering the adjustable mill onto the fish to adjust a mode of the adjustable mill; and drilling the fish out of the well using the adjustable mill.

12. The method of claim 11, wherein the cylinder further comprises at least one nozzle traversing longitudinally through the cylinder creating a hydraulic connection between the orifice and an external environment.

13. The method of claim 12, wherein drilling the fish out of the well using the adjustable mill further comprises pumping a fluid from the deployment device to the adjustable mill.

14. The method of claim 13, wherein drilling the fish out of the well using the adjustable mill further comprises pumping the fluid through the at least one nozzle into the external environment.

15. The method of claim 11, wherein the lock ring seat further comprises a first lock ring seat, a second lock ring seat, and a third lock ring seat.

16. The method of claim 15, wherein lowering the adjustable mill onto the fish to adjust the mode of the adjustable mill further comprises placing the adjustable mill in a first mode by pushing the lock ring into the first lock ring seat.

17. The method of claim 16, wherein lowering the adjustable mill onto the fish to adjust the mode of the adjustable mill further comprises placing the adjustable mill in a second mode by pushing the lock ring into the second lock ring seat.

18. The method of claim 17, wherein lowering the adjustable mill onto the fish to adjust the mode of the adjustable mill further comprises placing the adjustable mill in a third mode by pushing the lock ring into the third lock ring seat.

19. The method of claim 11, wherein the deployment device further comprises a drill string having a milling bottom hole assembly.

20. The method of claim 19, wherein the milling bottom hole assembly further comprises a drill collar, a junk basket, a magnet, and a jar.

* * * * *